United States Patent [19]

Polak

[11] Patent Number: 4,915,344

[45] Date of Patent: Apr. 10, 1990

[54] QUOIN MOLD

[76] Inventor: Thomas L. Polak, 1625 Wassergass Rd., Hellertown, Pa. 18055

[21] Appl. No.: 202,214

[22] Filed: Jun. 3, 1988

[51] Int. Cl.[4] ..... E04F 21/04

[52] U.S. Cl. ..... 249/15; 249/194; 249/219.1

[58] Field of Search ..... 249/13, 15, 16, 19, 249/48, 51, 83, 90, 191, 193, 194, 219.1; 264/33, 35; 52/259

[56] References Cited

U.S. PATENT DOCUMENTS

| | | | |
|---|---|---|---|
| 1,564,578 | 12/1925 | Kennedy | 264/33 |
| 2,286,531 | 6/1942 | Fralick | 249/15 |
| 2,616,145 | 11/1952 | Dufford | 249/15 |
| 2,893,098 | 7/1959 | Tilley | 249/15 |
| 3,426,490 | 2/1969 | Taylor | 249/15 |
| 3,653,629 | 4/1972 | Keyston | 249/19 |
| 4,659,055 | 4/1987 | Hardt | 249/19 |
| 4,696,451 | 9/1987 | Mansfield | 249/15 |
| 4,793,586 | 12/1988 | Buss | 249/15 |

*Primary Examiner*—James C. Housel

[57] ABSTRACT

A mold is made for molding artificial quoins. The mold is made from plastic structural sections in two main pieces which may be interengaged together by means of a straight and hooked detent cooperating together with the hook on the opposite side on adjacent interengaged arms to provide more security. The mold forms quoin facsimiles upon the surface of the buildings to imitate quoin blocks on such corners.

7 Claims, 3 Drawing Sheets

QUOIN MOLD

BACKGROUND OF THE INVENTION

1. Field of the Invention

This invention relates generally the art of molding, more particularly to the art of molding on building structures and more particularly still to the art of molding artificial quoins on the surface of the corners of a building.

2. Description of the Prior Art

The term "quoin" refers broadly to the external corners of a building and more especially to any large square or rectangular stones set into the corners of a building and in effect determining the outlines of such corner. While the term quoin refers generally to a structural unit in a building such as a corner stone or the corner so constructed, the term in modern times can also indicate any fancy work or artificial representations of actual quoins or the like. For example, owners of buildings covered with artificial coatings such as stucco, brickcoat, veneers representing masonry, or the like may desire the production of artificial or surface quoins on the corners of such buildings to make the buildings appear to have quoin-type construction. Particularly in the case of a veneer or representation of masonry or brick, an artificial quoin adds realism. Artificial quoins also may be used on an actual masonry surface to add an extra sophistication.

Artificial quoins are frequently, if not usually, outwardly offset from the surface of the corner of the building. Sometimes the artificial quoins are precast off the job site and adhered to the building by means of adhesive grout or the like, sometimes aided by additional fastening means. Most artificial quoins, however are formed in situ from plastic materials such as grout, concrete or other materials. Since such quoins are inherently positioned on vertical as opposed to horizontal surfaces during molding, it is difficult both to form veneer or surface-type quoins and to support or maintain them in place until they become self-supporting through consolidation of the forming material.

In the past, it has been customary when an artificial quoin or the like is to be formed, to construct, or "box out" a temporary form or mold on the side of the building. This can be accomplished by nailing a series of wooden pieces against the sides of the building in a more or less square or rectangular configuration. Moist concrete or other material may then be packed or troweled into the opening between the wooden pieces until a compact mass is established at which point any necessary sculpturing of the surface can be accomplished. After the moist material sets, depending upon the material, in a few hours or a few days, the wooden mold pieces can be removed. The process of constructing the temporary mold in situ and then removing after the material has set is time consuming, particularly because of the necessity to square the mold accurately during construction and the necessity to individually secure and later remove the mold pieces. The surface of the resulting quoin, furthermore, often lacks both precision and a smooth surface texture.

OBJECTS OF THE INVENTION

It is an object of the invention, therefore, to provide a quickly and simply adjustable mold for the formation of artificial quoins on a building surface.

It is a further object of the invention to provide a simply constructed readily mountable and dismountable quoin mold which can be applied within a minute or less and can be removed equally expeditiously.

It is a still further object of the invention to provide an easily assembled two part mold, the interchangeable parts of which can be readily interengaged and disengaged before and after use.

It is a still further object of the invention to provide an inlockable mold that can be readily adjusted for angles less than about 90 degrees and readily mounted in place on a building to aid in molding an artificial quoin.

It is a still further object of this invention to provide a quoin mold formed of two separate sections which are interengageable with each other to form a single mold section in a shape to fit around the corner of a building.

It is a still further object of this invention to provide a two part quoin mold in which the two parts have the same interlocking means positioned substantially identically on the two parts.

It is a still further object of this invention to provide a quoin mold formed of substantially identical parts which can be opposed to form a corner mold.

It is a still further object of the invention to provide a method of molding artificial quoins including interlocking two interengageable sections of a mold in position about the corner of a building, securing the mold parts to the building surface, applying unconsolidated plastic material in the mold cavity, allowing the unconsolidated material to consolidate and removing the mold sections.

It is a still further object of the invention to provide a method of molding an artificial quoin on the corner of a building including the erection of a two piece quoin mold on the building wherein the two sections of the mold are interengaged by sliding detents, one of which is in the form of a hook element which fits over the opposite section.

Other objects and advantages of the invention will be or become evident from the following description in light of the appended drawings.

BRIEF DESCRIPTION OF THE INVENTION

The present invention comprises a mold for forming artificial quoins on the corners of a building. The mold is formed as a two part or two section mold which, when the parts are detachably interengaged, may be secured to the corner of the building with one part on or against one wall and the other part on or against the other wall forming the corner so the mold as a whole extends about the corner of the building. Unconsolidated plastic material may then be troweled or otherwise applied to or into the central opening of the mold enclosure and allowed to consolidate after which the mold may be removed from the building surface leaving a molded section simulating a quoin or other type of ornamentation. The two sections of the quoin mold are preferably open ended and interengage through the agency of a two part interengagement means. Such interengagement means includes a substantially right angle hook provided on the end of one of the side portions of each mold section and a substantially straight detent means provided on the other side portion of each mold section. When the two mold sections are interlocked, the right angle hook on each section engages with the flange or other rigid portion of the opposite section which is positioned generally at a right angle with respect to the first mold section. In a preferred embodiment, the mold surface portion and the detent engaging portion comprise the two flanges of a structural angle. The straight detent extends beyond the end of the beveled end of the section upon which it is secured and is engaged on one side with the beveled sections along an already beveled section and on the other side with the side of the right angle hook extension. The straight extension prevents transverse movement of the two mold sections parallel to the general plane of each of the mold sections and the hook, when engaged with the opposite flanges of the opposite section, prevents displacement at an angle to the flange.

DESCRIPTION OF THE PREFERRED EMBODIMENTS

In recent years it has become popular to ornament buildings with built-out or projecting sections, particularly at the corners of the building, where structures known as quoins may be provided, particularly in brick or masonry buildings. Actual quoins are large stone or concrete blocks at the corners of a stone or brick building. When an artificial surface is provided on a building designed to look like a stone, brick or stucco surface, it is often desired to provide ornamental work at the corners of the building to make it look like the building is provided with quoins or large blocks of stone or concrete making up the corners of the building. Such quoins provide a more substantial look to the face of a building. The artificial quoins are usually molded on the job site from plastic material such as moist concrete, stucco, or the like. Such fancy work can be molded by hand on the building surface, but this is very time-consuming and difficult. Consequently, it has been the practice generally, to nail or otherwise secure mold pieces in a so-called "boxed-out pattern" on the corner of the building and then supply plastic material such as concrete, stucco or the like within the mold by a trowel or other implement. The unconsolidated plastic material is forced against the sides of the wooden box pattern to provide the outer edges of the artificial quoin representation. After the unconsolidated material sets or consolidates, the boxed mold structure is removed from the surface by means of a crowbar or clawhammer or the like, leaving the quoin representation adhering to the surface of the building. While the use of the boxed-in molds, which are usually constructed from wood or the like, is an improvement on essentially freehand molding of quoin representations, the forming of artificial quoins with boxed-in molds is still timeconsuming and skilled labor, which can only be effectively accomplished by highly skilled workmen.

The present invention provides a very effective, economical and easily constructed mold for use in forming artificial quoins on building surfaces.

Figure 1:
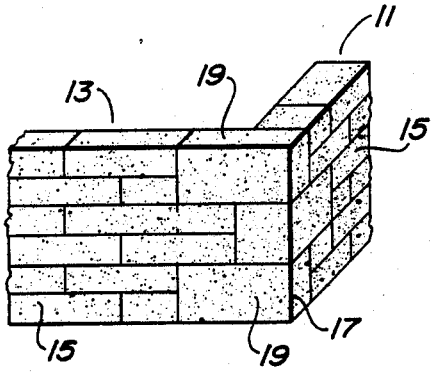
FIG. 1 is an isometric sketch of quoins, i.e. large blocks, used at the corners of a masonry or in this case, a brick building.

FIG. 1 is a diagramatic sketch of two building walls 11 and 13 formed from brick-type materials 15. The corner 17 where the two walls 11 and 13 meet is provided with or constructed from large stone blocks 19, known as quoins, which provide increased mass to the corners of the building and consequently increased strength to such building at the corners.

Since masonry and brick buildings and walls such as shown in FIG. 1 are comparatively expensive, it has in recent years become popular to provide surfaces to wooden and paneled-type buildings which provide an appearance of masonry or brick construction. Such facings on the building are actually a fairly thin facing or veneer which provides an appearance of the heavier masonry or brick construction. Sometimes a facing comprising a single course of brick or even thin masonry may be used over a basically frame construction, while at other times only a thin veneer of another material made to look like a brick or masonry facing may be used. With the advent of such veneers representing other types of heavier masonry or brick construction, it has become popular more recently still to provide a representation of quoins at the corners of such buildings. These artificial quoins provide a more massive and decorative appearance to the buildings on which they are provided. Since the representations of quoins are only used at the corners of the building, they have usually been fabricated on the job, usually by molding concrete, stucco or the like unconsolidated plastic-like material on the surface into the form of the outer surface of a quoin. Such molding can be done completely manually or freehand, but this takes an inordinate amount of time and is quite uneconomical. Another frequently used device is to "box in" a wooden mold on the surface of the building at the corners by nailing light wooden timbers on the surface. Unconsolidated material is then troweled into the area between the light timber or other wooden strips and pressed against the sides of such strips to provide an essentially stucco surface extending from the face of the building. Reinforcing means such as wire netting or the like may be placed within the confines of the boxed-in mold prior to the application of the unconsolidated material into such mold.

The present inventor has discovered that a much more efficient application of plastic unconsolidated material to the walls of a building to form artificial quoin representations can be accomplished by the use of a prefabricated and reusable mold formed from two substantially similar sections which detachably engage in the center to form a mold which can be easily and quickly applied to the surface of a building and is easily and quickly removed after the consolidation of material molded within the confines of the mold.

Figure 2:
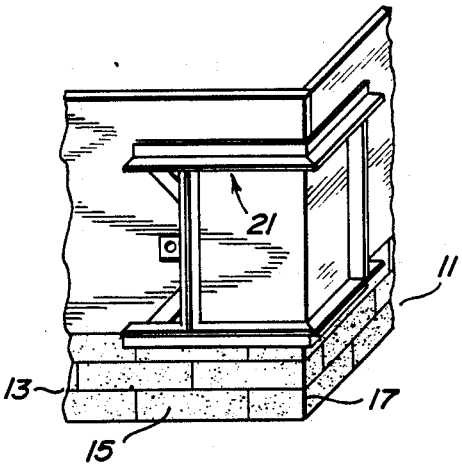
FIG. 2 is an isometric drawing of the corner of a building with a quoin mold applied to the surface of the building and positioned for receipt of plastic material to form a built out quoin face.

FIG. 2 shows a quoin mold 21 in accordance with the present invention secured to the surface of a building at the corner 17 where the two walls 11 and 13 meet. The mold in FIG. 2 is shown just after having been attached or secured to the wall of the building and before plastic material is troweled therein. A course of bricks is shown positioned below the mold, but this is not necessary.

Figure 3:
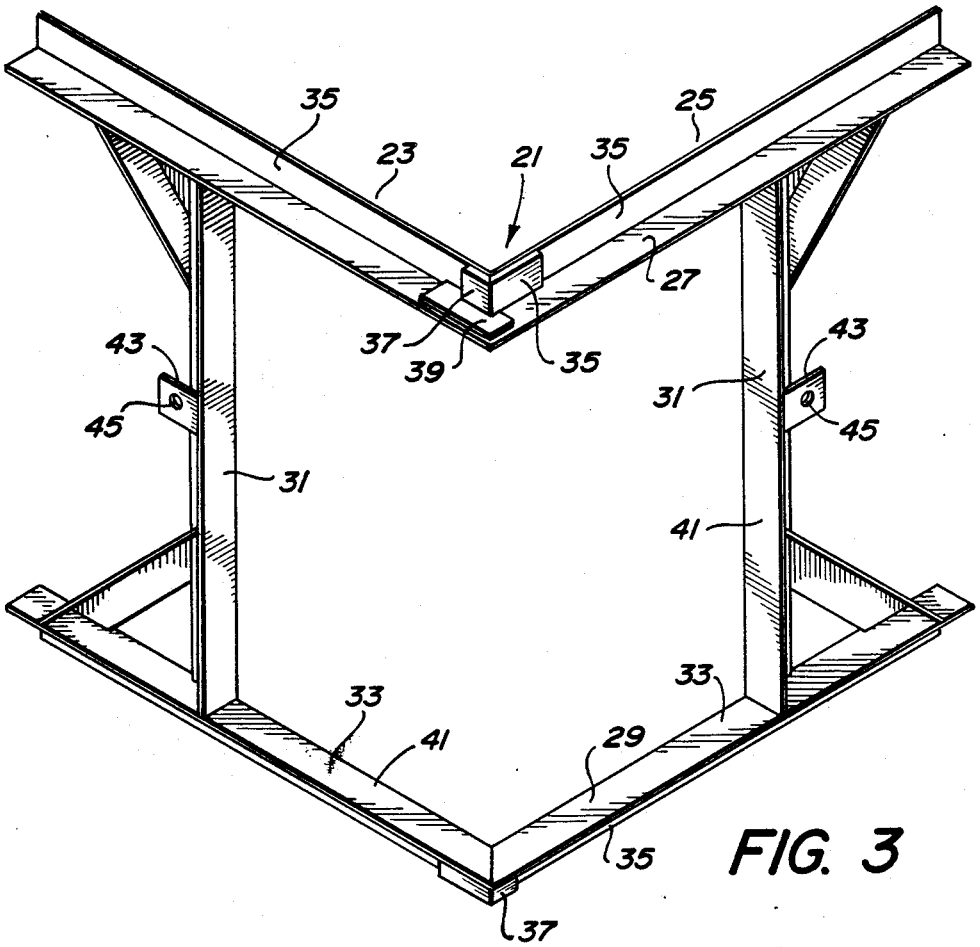
FIG. 3 is an isometric view of the outer face of the quoin mold of the invention.
Figure 4:
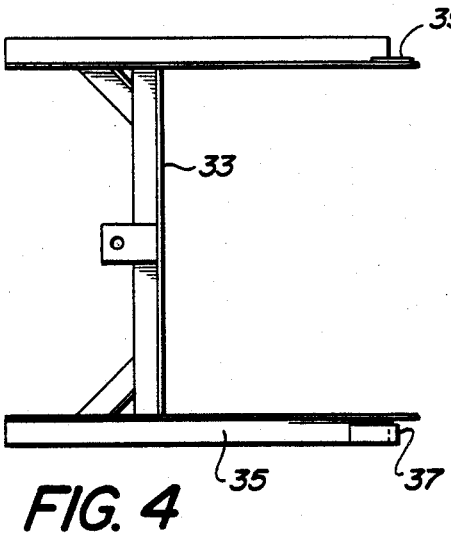
FIG. 4 is an elevation of the front of one of the sections of the quoin mold shown in FIG. 3.
Figure 5:
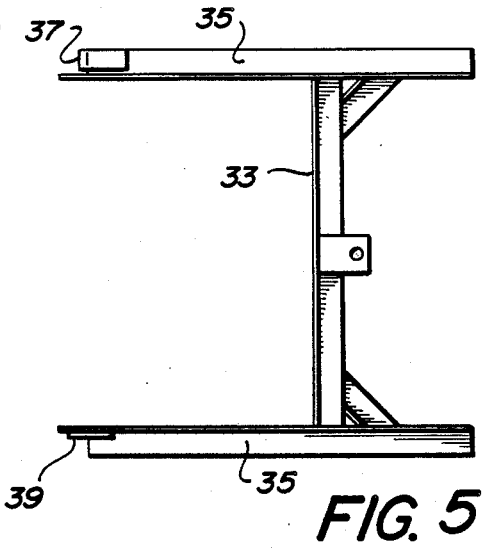
FIG. 5 is an elevation of the front of the other section of the quoin mold shown in FIG. 3.

FIG. 3 is an enlarged representation of the mold of the invention shown in FIG. 2 set up independently in the position which it takes upon the wall of a building to illustrate the construction. The quoin mold 21 shown in FIG. 3 is formed from two separate open sided sections or constructions 23 and 25. Each section or construction may be considered to have a major plane parallel to its major dimensions and a minor plane parallel to its minor dimensions at right angles to the major plane. Each such construction 23 and 25 is assembled or formed from a first upper horizontal member 27 and a second or lower horizontal member 29 connected together toward one end by an intermediate vertical member 31. Each of the members 27, 29 and 31 are formed preferably as shown in the drawings of structural angle members, each of which comprises two flanges. Members 27, 29 and 31 are arranged so that one flange 33 serves on one side as the face of the smooth mold surface while the other flange 35 serves as a reinforcing member which stiffens the mold surface member or flange. The construction of both mold sections or constructions 23 and 25 are identical. Consequently, the same parts are identified by the same identification numbers. FIGS. 4 and 5 show the two mold sections 23 and 25. The same reference numerals, therefore, are used to identify both sets of structural members. When a part on section 23 is specifically referred to it is followed by the designation (a) while a part on section 25 is specifically identified by the designation (b) following the reference numeral of the part.

FIGS. 4 and 5 show elevations of the two mold constructions or sections 23 and 25. The two constructions are preferably, when in use as a mold, interengaged by interengagement means which will be presently described at the terminus or end of each arm. These constructions are each supplied with two interlocking means. The basic reference numberals are the same as in FIG. 3.

Figure 6:
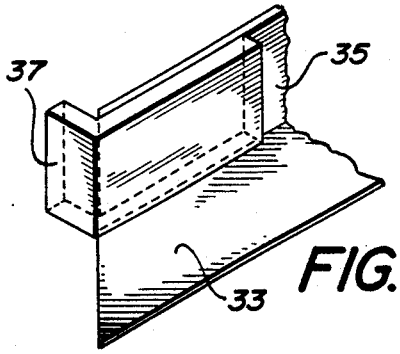
FIG. 6 is an enlarged isometric view of the end of one of the sections of the quoin mold shown in FIG. 3 and showing the right angle hook detent.
Figure 8:
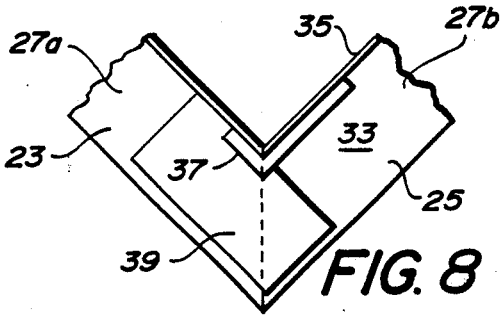
FIG. 8 is an enlarged view of the ends of the top arms of the two sections of the mold shown in FIGS. 6 and 7 interengaged with each other.
Figure 7:
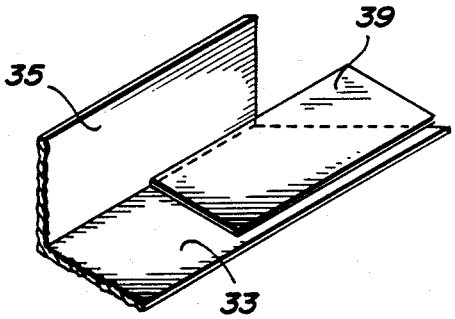
FIG. 7 is an enlarged isometric view of the end of the opposite section of the quoin mold shown in FIG. 3 showing the straight detent.

In FIG. 4 there is shown an elevation of one of the two mold construction sections and in FIG. 5 there is an elevation of the other mold construction section. These mold constructions may be conveniently formed from a suitable plastic material. Each construction section arm has on the end on one of the flanges a hook or detent 37 and on the opposite arm and flange there is a substantially straight detent 39. It will be understood that when the two mold constructions 23 and 25 are placed together, there will be a hooked detent 37 and a straight detent 39 at each intersection of the arms. The ends of two of the arms in the mold constructions 23 and 25 are shown in FIGS. 6 and 7 in additional scale, or enlarged. FIG. 8 in addition shows the two adjoining members interengaged with each other with the hooked detent 37 and straight detent 39 in position with the two members 23 and 25 meeting at substantially 90 degrees. It can be seen in FIG. 8 that the straight detent 39 prevents relative movement between the two sections 23 and 25 or horizontal members or arms 27*a* and 27*b* of such sections toward and away from the viewer. The straight detent 39 is securely attached to the back of the molding flange 33 on the horizontal member or arm 27 mold construction or section 23. The straight 39 detent, furthermore, as can be seen in FIG. 8, extends at its free end, beyond the end of the arm on the mold construction 23 and over the end of the adjoining arm of mold construction 25. The straight detent also passes behind the hook portion of the hooked detent 37 and is, therefore, prevented by the hooked detent and the adjacent mold flange from movement towards and away from the observer. The hooked detent 37, on the other hand, which is mounted on the reinforcing flange 35 of the horizontal member or arm 27*b*, prevents movement of the arm of section 25 perpendicularly away from the arm of section 23.

Figure 9:
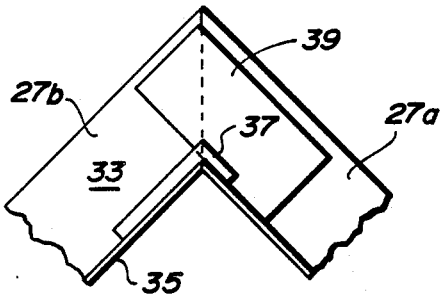
FIG. 9 is an enlarged view of the ends of the two bottom arms of the two sections of the mold interengaged with each other.

FIG. 9 shows the other two lower arms of the two constructions or sections 23 and 25 interengaged together and it will be seen that the hooked detent 37 and the straight detent 39 are positioned respectively on opposite side of the arms from the arrangement shown in FIG. 8. This arrangement of the detents is very desirable to form an easily disengageable yet secure interengagement of the adjoining arms of the two mold sections or constructions.

Figure 10:
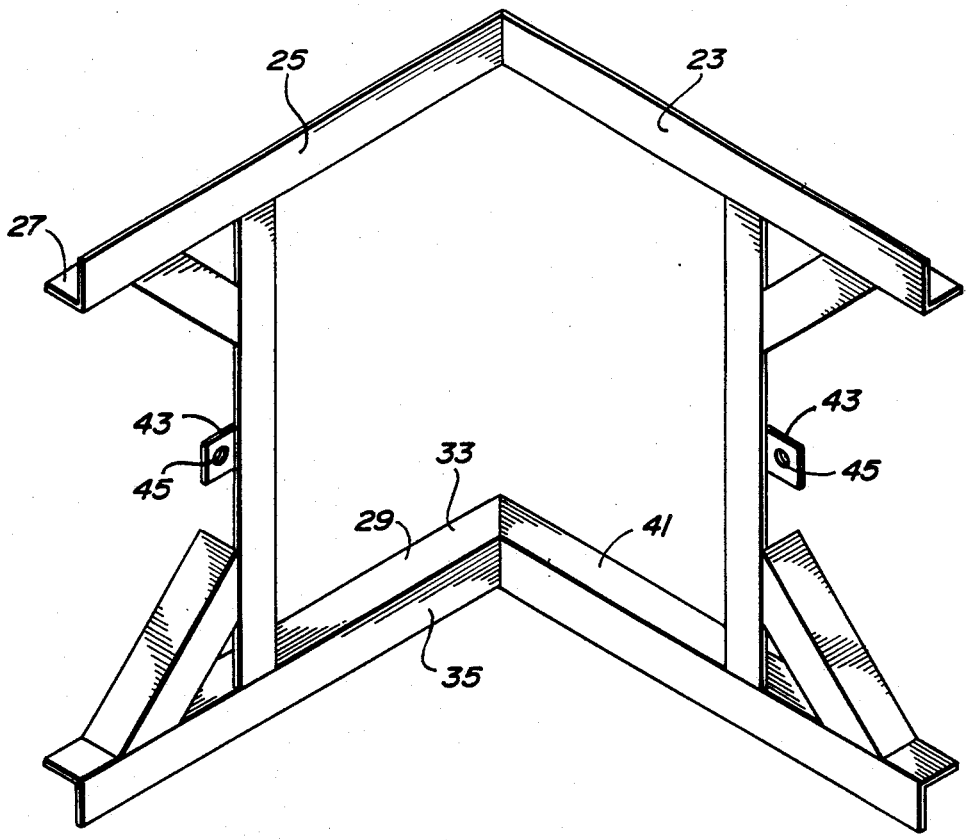
FIG. 10 is an isometric view of the inner face of the quoin mold of the invention.

FIG. 10 is a view of the opposite side of the quoin mold from that shown in FIG. 3. The smooth mold surface 41 on the molding flange of the lower horizontal member may be seen. The only break in the smooth pattern of the mold surface is the diagonal intersection between the two arms. When the arms, however, are brought close together as shown, the diagonal intersection makes only a minor break in the overall smooth mold surface of the construction. The same smooth mold surface may be seen on the bottom portion of the mold as shown in FIG. 3. Two securing flanges 43 are shown in both FIG. 3 and FIG. 10 in position for a nail or other fastening to be driven through the orifice 45 in the center of the securing flanges 43.

It will be understood that in assembling the mold sections or constructions together, prior to securing them to the building structure, the ends of the arms 27*a* and 27*b*, and 29*a* and 29*b* are brought close together. The end of the arm containing the straight detent then is moved longitudinally against the end of the arm bearing the hooked detent in a position such that the straight detent slides over the surface of the opposite arm and behind the hooked detent of the reinforcing flange of the opposite arm. The longitudinal movement of the arm is then continued until the forty-five degree beveled portion of the two mold flanges abut and the straight detent is securely positioned under the hooked detent on the opposite reinforcing flange. A secure corner interengagement is, at this point, ensured. The only way the arms may then be disengaged is by sliding the one arm longitudinally until the reinforcing flange slips from beneath the hooked detent on the opposite reinforcing flange. This is easily done once the knack of the particular movement is obtained. However, accidental disengagement of the two pieces is minimized by the fact that the detent on the other two arms is disposed in the opposite direction, tending to prevent longitudinal movement of the reinforcing flange away from the hook on such arm.

Once the mold has been erected on the job site, it may be immediately nailed or otherwise secured to the corner of the building ends where plastic concrete or stucco may be immediately troweled into the center of the mold to form an artificial quoin. After the plastic material sets, the mold may be removed simply by removing the fastening from the two orifices.

It is also possible to preform artificial quoins of appropriate dimensions away from the building and then use the quoin mold of the invention to support such preformed quoins in position on the building until the adhesive material used to adhere the quoin to the building sets. The most useful function of the quoin mold of the invention, however, is in forming artificial quoins in situ or in place upon a building.

While the present invention has been described at some length and with some particularity with respect to the embodiment shown, it is not intended that it be limited to any such particulars, but is to be construed broadly with reference to the appended claims so as to provide the broadest possible interpretation of such claims in view of the prior art and thereby to effectively encompass the intended scope of the invention.

I claim:

1. A quoin mold for forming artificial quoins on the corners of buildings, said mold comprising:

first and second mold sections, each section including first and second arms each having first and second ends, said second ends being connected by a third arm, said arms of each section defining a plane and each arm having a mold surface transverse to said respective plane; and interlocking means provided on each first end of said first and second arms of the first mold section for engagement with respective interlocking means provided one each first end of said first and second arms of said second mold section for interengagement of the first ends of the respective arms of the sections thereby connecting said sections together, said interlocking means preventing movement both parallel to said planes and angular movement between said planes to an angle greater than substantially perpendicular, while allowing angular movement between said planes to an angle less than substantially perpendicular.

2. A quoin mold in accordance with claim 1 wherein the interlocking means while not allowing movement between the planes except to an angle less than perpendicular to each other, allows movement of one of the first and second arms of each section perpendicular to the respective interengaged arm of the other section, the allowable movement of one pair of interengaged arms being perpendicular to the plane of one section and the movement of the other pair being perpendicular to the plane of the other section.

3. A quoin mold in accordance with claim 1 wherein the arms each comprise a structural member incorporating said mold surface on a first side of a first flange which delineates the inside of the quoin mold and a second flange extending from the first flange on a second side opposite to said first side.

4. A quoin mold in accordance with claim 3 wherein at least one of the first and second sections comprises said three arms attached perpendicularly to each other to form an open-sided rectangular mold section.

5. A quoin mold in accordance with claim 3 wherein the interlocking means comprise:

(a) an elongated detent means attached to the second side of the first flange of the first arm of each section and extending beyond the first end of the first arm of each section for sliding engagement with the corresponding second side of the first flange provided on the other section, and (b) a short angle section secured to the second flange at the first end of the second arm of each section, the short angle section being secured when the sections are interengaged together by extending over the first end of the corresponding second flange of the opposing first arm of the other section.

6. A quoin mold in accordance with claim 5 wherein said interlocking means additionally includes an angled stop means at the first ends of the first and second arms of one section cooperating with angled stop means at the first ends of the first and second arms of the other section by abutment thereagainst when the two sections are interengaged to prevent angular movement of the planes defined by the sections to an angle substantially greater than ninety degrees to each other.

7. A quoin mold in accordance with claim 6 wherein the stop means comprises cooperating beveled surfaces at the first ends of the first flanges arranged and constructed to abut each other when the two sections are interengaged.

* * * * *